United States Patent [19]

Kim

[11] Patent Number: 5,045,004

[45] Date of Patent: Sep. 3, 1991

[54] TURBO-HYDRODUCT PROPULSION SYSTEM

[75] Inventor: Yong Kim, Fountain Valley, Calif.

[73] Assignee: Allied-Signal Inc., Morris Township, N.J.

[21] Appl. No.: 413,925

[22] Filed: Sep. 28, 1989

[51] Int. Cl.[5] ..... B63H 11/14

[52] U.S. Cl. ..... 440/45; 440/44; 114/337; 114/20.2

[58] Field of Search ..... 114/20 A, 20 R, 337; 440/44, 45, 38; 60/221, 222, 39.05, 613, 39.53, 39.56–39.59, 39.3

[56] References Cited

U.S. PATENT DOCUMENTS 3,134,353 5/1964 Pedersen et al. ..... 60/221 X 3,643,438 2/1972 Barsby ..... 440/45 X

FOREIGN PATENT DOCUMENTS 1323871 7/1973 United Kingdom ..... 490/45

*Primary Examiner*—Ed Swinehart

*Attorney, Agent, or Firm*—David B. Abel; Terry L. Miller; Robert A. Walsh

[57] ABSTRACT

The invention defines a propulsion system for an underwater vehicle. More particularly, the invention describes a turbo-hydroduct propulsion system which operates on stored, high energy fuel. The fuel is combusted and powers a turbopump which pressurizes ingested water to a very high pressure. The pressurized water is subsequently exhausted from the vehicle to produce thrust.

27 Claims, 4 Drawing Sheets

FIG. 4
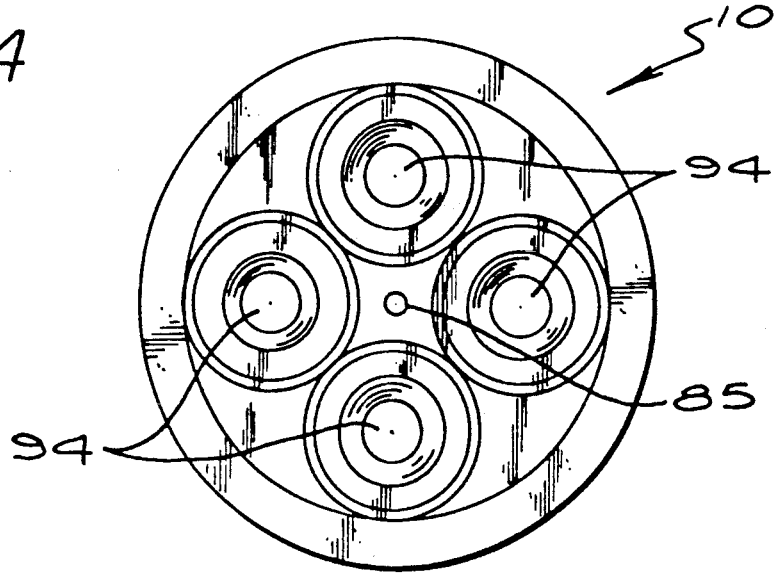
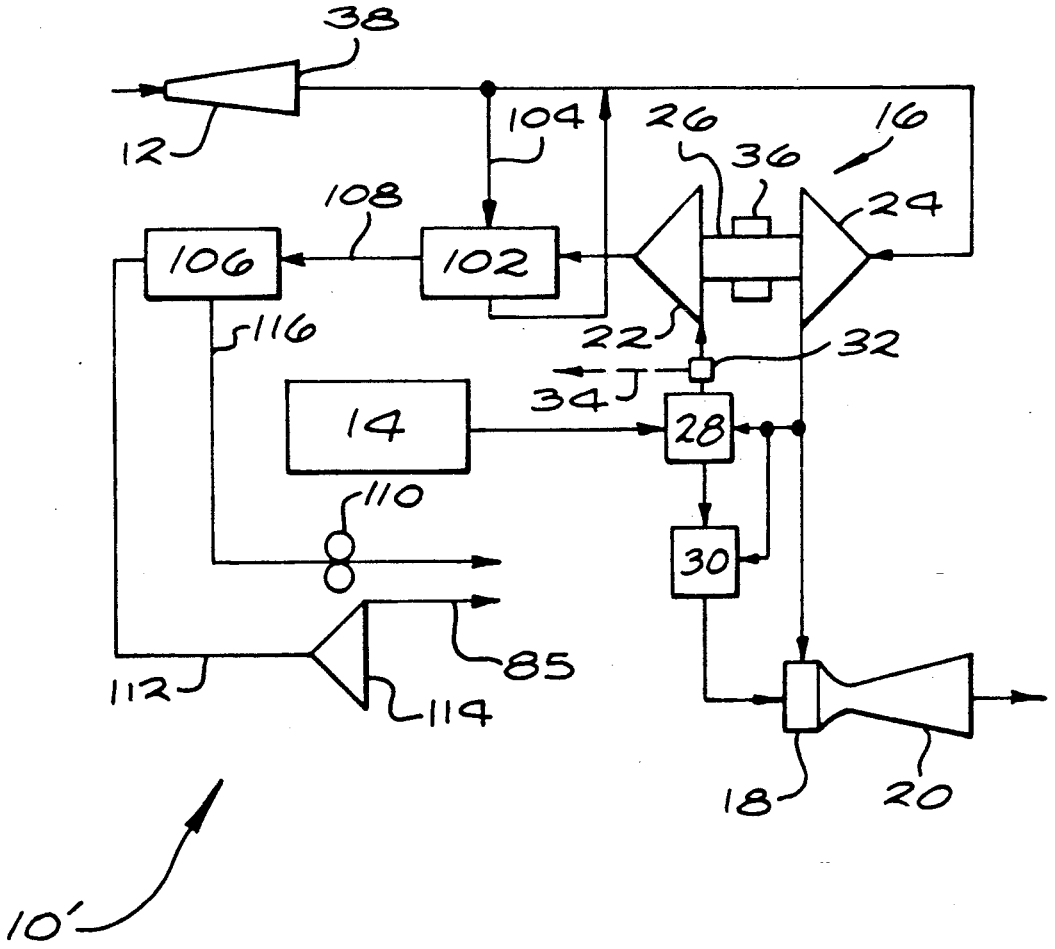
FIG. 5

TURBO-HYDRODUCT PROPULSION SYSTEM

BACKGROUND OF THE INVENTION

The present invention generally relates to the field of underwater vehicle propulsion. More specifically, the invention details a turbo-hydroduct propulsion system for use within a high speed underwater vehicle.

Present underwater propulsion concepts are all poorly suited for high-speed, intermediate-range underwater vehicles. Propulsor-driven systems such as pumpjets, counter-rotating propellers, and supercavitating propellers are capable of long-range operations but are limited to moderate speeds, because they require excessively large power plants for high-speed operation. Rocket propulsion systems, on the other hand, are capable of very high speeds, but their applications are limited to short-range operations because of their inherently low propulsion efficiencies.

SUMMARY OF THE INVENTION

The turbo-hydroduct propulsion system is a generic propulsion concept involving a gas generation subsystem, a turbine-drive subsystem, a high-speed turbopump subsystem and a multiphase flow thrust nozzle subsystem. Numerous derivatives of the basic concept exist because many options are available for each subsystem and the subsystems can be integrated in various ways. This variety of concepts offers new dimensions to the design and functioning of high-speed underwater propulsion systems, and enables the turbo-hydroduct concept to be tailored to meet the design requirements.

The turbo-hydroduct is a multiphase flow jet propulsion system that incorporates several propulsion features of waterjet into an underwater ramjet propulsion or hydroduct system. Water is admitted at an inlet, recovers its dynamic head at a diffuser, is pressurized to optimum pressure at a turbopump, and is routed to a mixing chamber where it is sprayed into a high pressure gas stream to form a dispersed multiphase flow. The resultant high pressure, multiphase flow expands through a converging-diverging nozzle, or an array of nozzles, to produce vehicle thrust. The thrust produced per unit water flow rate, i.e. water-specific impulse, is much greater than a water jet because of the high nozzle exit velocity and mass associated with the dispersed multiphase flow.

The turbopump is powered by a turbine-drive system which can be simply a high-pressure gas source or a more involved system such as a Rankine-cycle power plant utilizing propellant heat of reaction as the energy source. The high-pressure gas is provided either by chemical reaction of propellants or conceivably from a stored gas source. The nozzle subsystem may involve a single multiphase flow nozzle or an array of nozzles tailored for specific operations and packaging requirements.

The turbo-hydroduct is reasonably efficient, relatively compact, and capable of a very high system-specific thrust. As a result, the turbo-hydroduct is ideally suite for high speed, high specific impulse, propulsion of an underwater vehicle.

BRIEF DESCRIPTION OF THE DRAWINGS

FIG. 4 is a schematic end view of the vehicle of FIG. 2.

FIG. 5 is a schematic of an alternate embodiment of the turbo-hydroduct propulsion system.

DESCRIPTION OF THE PREFERRED EMBODIMENT

Figure 1:
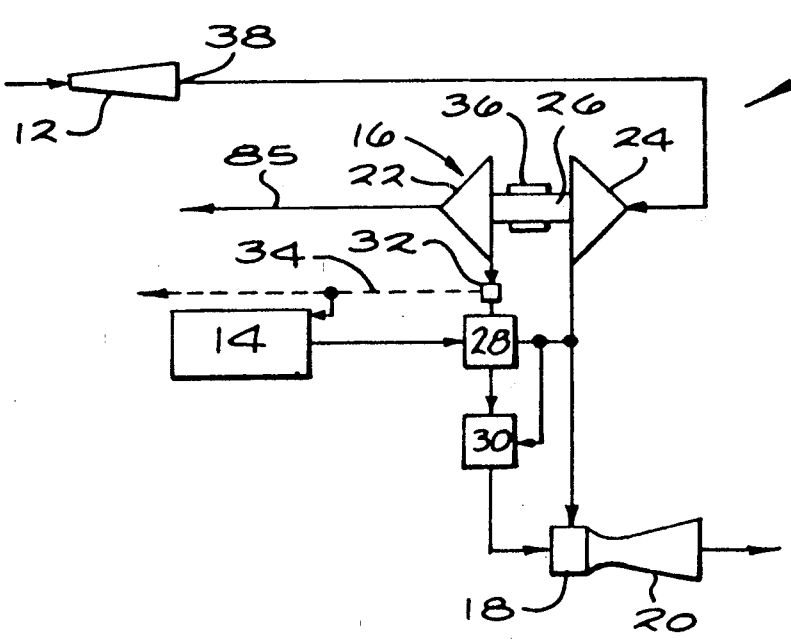
FIG. 1 is a schematic representation of the basic turbo-hydroduct propulsion system of the present invention.

The basic turbo-hydroduct propulsion system 10 is shown schematically in FIG. 1. The basic system 10 includes an inlet duct 12, a gas generator 14, a turbopump 16, a primary mixing chamber 18 and a nozzle assembly 20. The turbopump 16 includes a turbine 22 which drives a pump 24 via a shaft assembly 26. The system 1? may also include a second mixing chamber 28 and a third mixing chamber 30.

In operation, the turbine 22 of turbopump 16 is driven directly by gas produced from combustion of either solid, liquid, or hybrid propellants within the gas generator 14. Water may be sprayed into the combustion gases within the second mixing chamber 28 upstream of the turbine 22 to increase turbine flow rate by generating steam, and to lower the gas temperature to a level acceptable for the turbine 22. The exhaust from turbine 22 may be either directly vented overboard, routed to the nozzle assembly, or allowed to expand to a lower pressure, cooled, pumped back to ambient pressure, then discharged overboard.

The system 10 may additionally include a particle separator 32 positioned between the second mixing chamber 28 and the turbine 22. The particle separator 32 removes salts which are carried within the ingested water. When the water evaporates to steam in the second mixing chamber 28, the salts crystalize, forming discreet particles. The particle separator 32 removes the salt particles from the steam-gas flow. The salts are then either dumped overboard, or they may be stored within the volume previously occupied by the propellant as the propellant is depleted, via line 34.

Furthermore, the system 10 may include a generator 36 contained within the turbopump I 6 mounted about and integral with the shaft assembly 26. The generator 36 provides electrical power for various circuits and motors (not shown) aboard the underwater vehicle.

Water is admitted via inlet duct 12, which may include a diffuser 38 to recover the dynamic head of the ingested water, and directed to pump 24 of turbopump 16. Pump 24 is driven by turbine 22 to pressurize the ingested water to an optimum pressure. A portion of this pressurized water is what is added to the combustion gases for the turbine described above. The remainder of the pressurized water is ducted to the primary mixing chamber 18. Additionally, a fractional amount of the combustion gases from gas generator 14 are also ducted to mixing chamber 18. Within mixing chamber 18, the pressurized water is sprayed into the combustion gas flow to form a dispersed multiphase flow.

The resulting multiphase flow is expanded and accelerated through the nozzle assembly 20 to produce thrust. The gas and water flow streams are mixed at a pressure in excess of 300 pounds per square inch greater than ambient pressure. Preferably, the pressure is in excess of 1000 psi greater than ambient and ideally about 2000 psi greater than ambient. Additionally, a fractional amount of the pressurized water may be ducted to the third mixing chamber 30, mixed with combustion gases to form a low temperature steam-gas mixture, which is then ducted to the primary mixing chamber 18. The resulting multiphase flow is expanded and accelerates through the nozzle assembly 20, attaining speeds from 400 up to and in excess of 1000 feet per second, and potentially up to 2000 ft./s.

Figure 2:
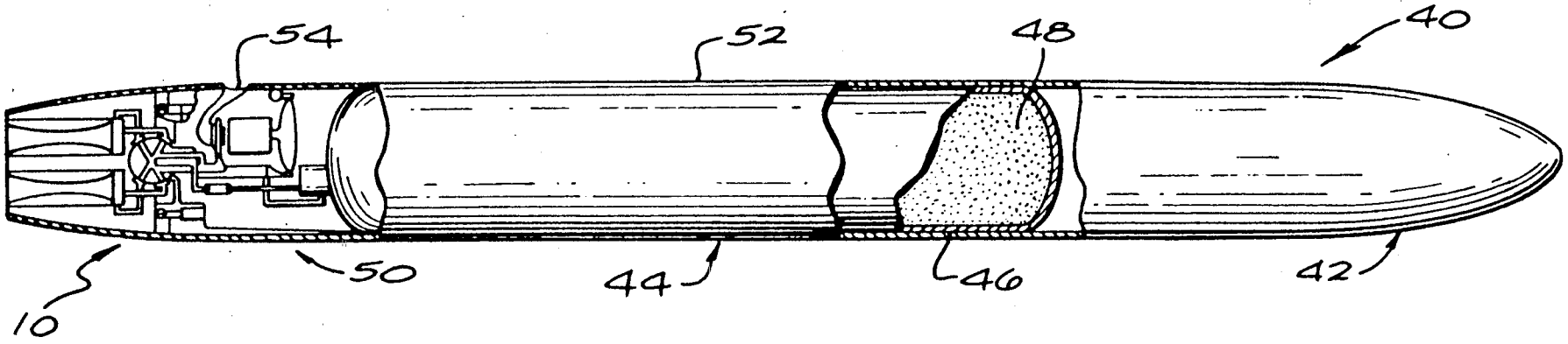
FIG. 2 is a schematic partially cut-away view of an underwater vehicle incorporating the turbo-hydroduct propulsion system of the present invention.

An underwater vehicle 40 incorporating the turbohydroduct propulsion system 10 is shown in a partially cutaway, schematic view within FIG. 2. The underwater vehicle 40 includes a forward section 42 which contains the payload and guidance systems (not detailed). A central section 44 contains the propellant storage tank 46, and high energy propellant 48 therein. An aft section 50 of the underwater vehicle 40 contains the propulsion system 10.

Figure 3:
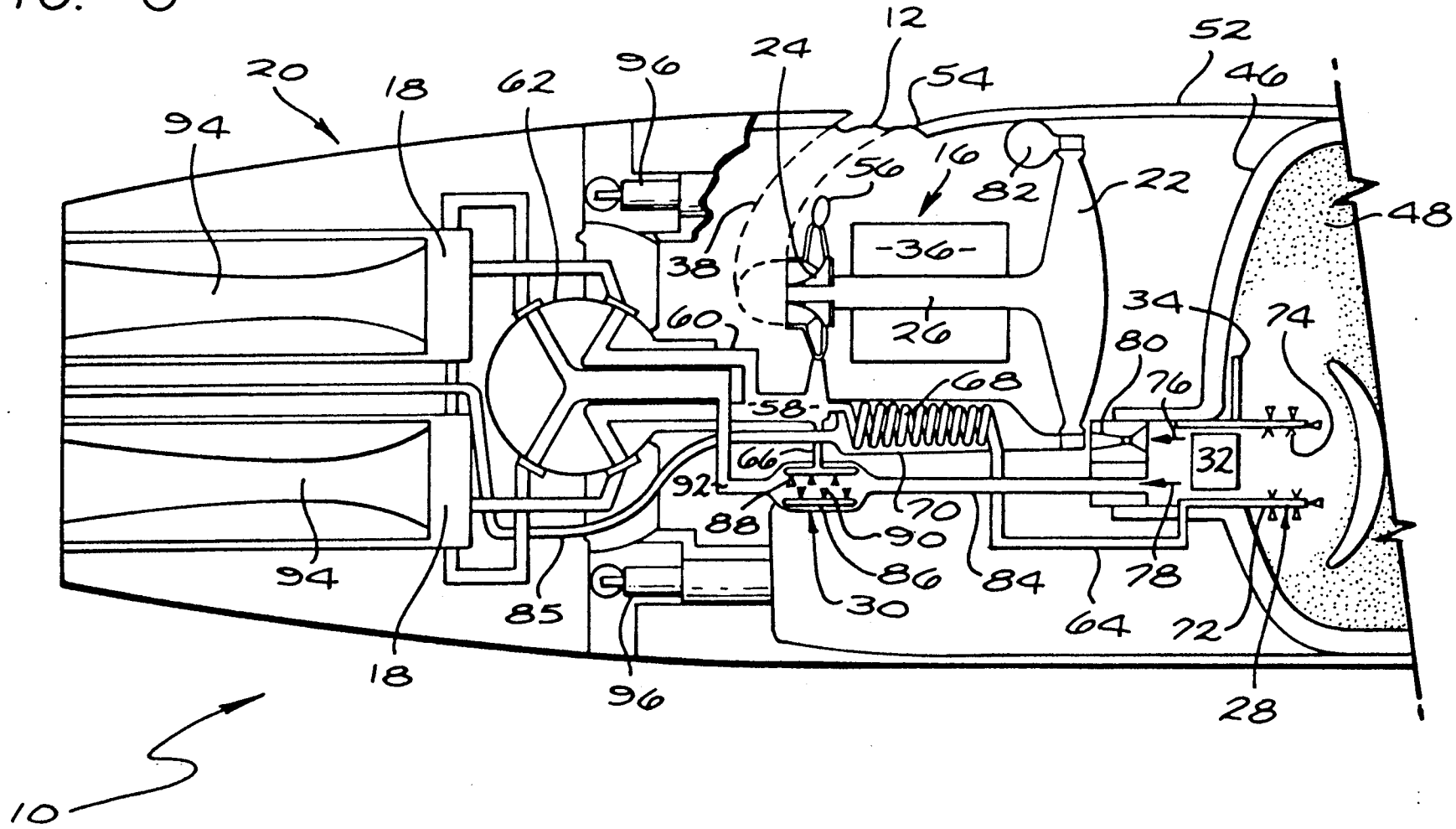
FIG. 3 is an enlarged view of the turbo-hydroduct propulsion system of the underwater vehicle of FIG. 2.

The aft section 50 including the propulsion system 10, is shown more clearly in an enlarged view within FIGS. 3 and 4. The underwater vehicle 40 includes a housing 52 into which all of the components are mounted. The housing has an opening 54 which allows water to flow through inlet duct 12 and diffuser 38 to the pump 24 of the turbopump 16. The pump 24 is preferably an axial inflow, radial outflow type capable of pressurizing the water to a minimum of 300 psi, and preferably to a pressure of between about 500 and 1000 psi. Ideally, the pump 24 operates without causing cavitation. A two stage pump having an axial flow stage and an axial inflow radial outflow stage may be required to attain the high pressures.

Pressurized water exiting pump 24 is gathered in a scroll 56 and conducted to a distribution chamber 58. From the distribution chamber 58, a first fractional portion of the pressurized water is diverted via conduits 60 through a thrust control valve 62 to one or a plurality of primary mixing chambers 18. A second fractional portion of the pressurize water is conducted via conduit 64 to the second mixing chamber 28, the remaining pressurized water is conducted via conduit 66 to the third mixing chamber 30.

Conduit 64 may include a heat transfer coil section 68 located within a heat transfer chamber 70. The heat transfer chamber 70 is also connected to receive the turbine exhaust gases which preheat the pressurized water within coil section 68 while being cooled to a lower temperature.

The second mixing chamber 28 is depicted as being partially enclosed within the propellant storage tank 46. The storage tank 46 also encloses the combustion of propellant 48, thereby acting as the gas generator 14 of FIG. 1. The second mixing chamber 28 is defined by a cylindrical water jacket 72 which receives heated, pressurized water from conduit 64. The water jacket 72 includes radially inwardly facing openings or nozzles 74 which spray the water into the combustion gases wherein the water vaporizes, producing the high temperature steam-gas mixture.

The high temperature steam-gas mixture produced within the second mixing chamber 28 is directed through the particle separator 32 wherein the salts are removed, and is then divided into two flow streams 76, 78. The salts are accumulated and transported into the storage tank 46, replacing the combusted propellant 48, via the line 34. Flow stream 76 proceeds through a nozzle 80 and is then directed upon the turbine 22, producing rotational motion thereof. Turbine 22 is preferably a single stage axial flow turbine, as shown. However, a multistage or radial turbine is also contemplated by the inventor. The turbine exhaust gas is collected within a turbine scroll 82 which ducts the gases to the heat transfer chamber 70, described above. The gases exiting the heat transfer chamber 70 are conducted to ambient via duct 85, or alternatively added to the primary mixing chambers 18.

The second flow stream 78 proceeds through a duct 84 to the third mixing chamber 30. The third mixing chamber 30 includes a generally cylindrical water jacket 86 containing a cavity 88. The water jacket 86 receives pressurized water from conduit 66, and distributes the water about cavity 88. The water is sprayed into the cavity 88 through a plurality of orifices 90 in the inner wall of waterjacket 86. The water vaporizes to steam, cooling the combustion gases, and producing a high pressure mixed gas-steam flow. This gas-steam flow is conducted within a duct 92 to the thrust control valve 62. The thrust control valve 62 directs the gas-steam flow received from duct 92 and the pressurized water from conduit 60 to one or a plurality of primary mixing chambers 18 associated with individual nozzles 94, contained within nozzle assembly 20.

The nozzle assembly 20 includes the thrust control valve 62 and either one or a plurality of nozzles 94. Preferably, there will be four nozzles 94, of the converging-diverging type, symmetrically spaced about the axis of the underwater vehicle 40. Each nozzle 94 has an associated primary mixing chamber 18 wherein the pressurized water and high pressure gas-steam flows are combined. The combined flow of high pressure water, gas, and steam expands and accelerates through the nozzles 94 attaining very high speeds, producing thrust and propelling the underwater vehicle 40 through the water.

The thrust control valve 62 distributes the water and gas-steam flows to the primary mixing chambers 18, and can vary the amounts being delivered. Thereby, the thrust control valve 62 can be used to control the direction of the underwater vehicle 40 by directing a disproportionate amount of flow, and thereby thrust, to one of the nozzles 94. Alternatively, or in addition, the underwater vehicle 40 may have a number of actuators 96 which can articulate the entire nozzle assembly 20 relative to the axis of the underwater vehicle 40 to produce directional thrust.

FIG. 4 shows a schematic view of the aft end of the nozzle assembly 20. The four nozzles 94 are spaced about the center of the underwater vehicle 40. The multiphase flow through the nozzles creates a low pressure zone in the area between the nozzles 94, at the center of the vehicle 40. Duct 85 is centrally located to exhaust the depleted combustion gases, from downstream of the turbine 22, into this low pressure zone between the nozzles 94. Thus, the propulsion system 50 can operate effectively at varying depths because the expansion of the combustion gases across the turbine 22 can be exhausted to an artificially low pressure.

FIG. 5 schematically depicts an alternate embodiment of the propulsion system 10' having similar components similarly numbered as those in FIG. 1, wherein the turbine exhaust gases from turbine 22 are passed through a condensor 102. The condensor 102 also receives a diverted portion of water flow from the inlet duct 12 via water conduit 104. The turbine exhaust gases are cooled in heat exchange relationship with the diverted water to cool and cause condensation of at least a portion of the gases. The cooled gases are then directed to a separator 106 through a duct 108. Within the separator 106, condensate fluids are separated and directed through a conduit 116 to a pump 110 wherein the fluids are pressurized before being discharged to ambient. Similarly, the gases from separator 106 are conducted via duct 112 to a compressor 114, pressurized, and exhausted to ambient through duct 85, configured as in FIG. 3. The pump 110 and compressor 114 may be electrically or hydraulically driven, or alternatively, powered by the turbopump 16.

Figure 6:
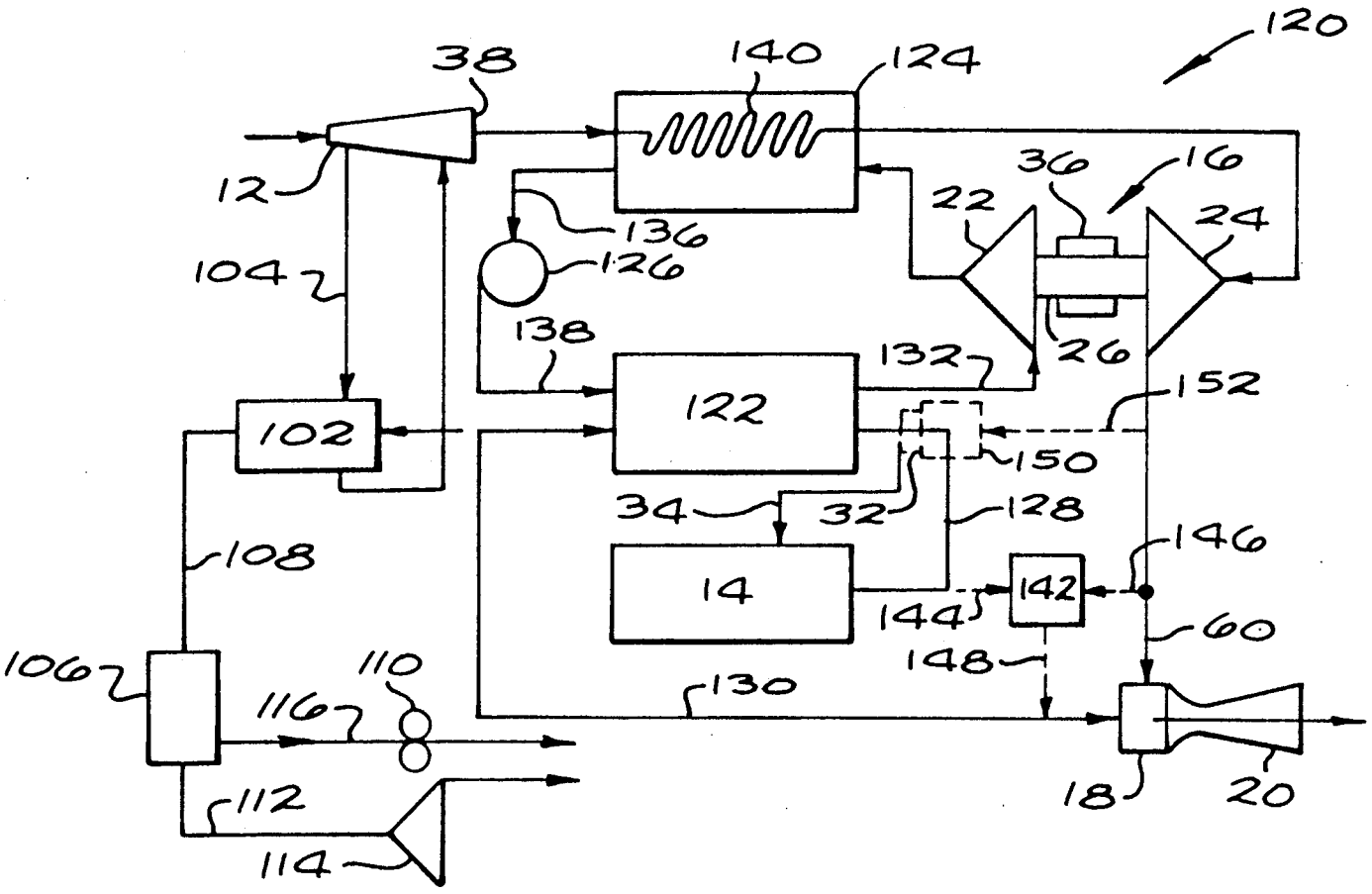
FIG. 6 is a schematic of a second alternate embodiment of the turbo-hydroduct propulsion system.

FIG. 6 schematically depicts another alternate embodiment for the turbo-hydroduct propulsion system 10 of the present invention, including a Rankine cycle powered turbine 22. Within FIG. 6, like components are similarly named and numbered as in FIGS. 1 and 3. Accordingly, the Rankine powered turbo-hydroduct propulsion system 120 includes gas generator 14, turbopump 16 primary mixing chamber 18, nozzle assembly 20, particle separator 32 and water inlet duct 12 which incorporates diffuser 38. Additionally, the system 120 includes a boiler 122, a condensor 124 and a pump 126, as well as additional conduits described more fully below.

Within the propulsion system 120, the gas generator 14 indirectly powers the turbine 22 of the turbopump 16 via a closed loop Rankine cycle. Combustion gases produced by the gas generator 14 are first conducted via duct 128 to the boiler 122, then to the primary mixing chamber 18 via another duct 130. Alternatively, the combustion gases from the boiler 122 are directed to condenser 102, then to separator 106 through duct 108. Within the separator 106, condensate fluids are separated and directed through conduit 116 to a pump 110 wherein the fluids are pressurized before being discharged to ambient. Similarly, the gases from separator 106 are conducted via duct 112 to a compressor 114, pressurized, and exhausted to ambient through conduit 85 configured as in FIG. 3. The pump 110 and compressor 114 may be electrically or hydraulically driven, or alternatively, powered by the turbopump 116.

The Rankine cycle includes a closed loop liquid-vapor cycle, wherein an appropriate liquid, preferably water, is first heated and boiled within the boiler 122 by the combustion gases. The resulting vapor in the form of steam is conducted within duct 132 from the boiler 122 to the turbine 22. The liquid may alternatively be superheated under pressure within the boiler 122, and then allowed to flash to steam at the inlet of the turbine 22. In either case, the steam imparts rotational power to the turbine 22 as it is expanded and cooled to a lower temperature and pressure. The turbine exhaust steam is then conducted to the condensor 124, via duct 134, wherein the steam is further cooled and condensed to a liquid. The liquid from the condensor 124 is collected and delivered to the pump 126 within a conduit 136. In the pump 126, the liquid is repressurized and then returned to the inlet side of boiler 122 via conduit 138 completing the closed cycle. Within the above cycle, water ingested through inlet duct 112 is routed through a cold pass coil 140 within the condensor 124 to cool and cause condensation of the steam therein. The now heated ingested water is- then delivered to the inlet of the pump 24 of the turbopump 16, wherein the water is pressurized to a very high pressure.

The high pressure water is delivered to the primary mixing chamber 18 associated with the nozzle assembly 20 through a conduit 60. As described above, the pressurized water and at least a fractional portion of the combustion gases are mixed within primary mixing chamber 18 and expelled through the nozzle assembly 20 producing thrust.

The propulsion system 120 may also include a premixing chamber 142. The premixing chamber 142 receives combustion gases directly from gas generator 14 via a duct 144, and pressurized water diverted from conduit 60 by a conduit 146. The amounts of combustion gases and pressurized water are controlled such that substantially all of the water vaporizes to steam. The resulting gas-steam mixture is then ducted to the primary mixing chamber through a duct 148.

Additionally, the propulsion system 120 may include a secondary mixing chamber 150 located between the gas generator 14 and the boiler 122. The secondary mixing chamber 150 receives a small amount of pressurized water diverted from conduit 60 via conduit 152. The pressurized water is mixed with the combustion gases and flashes to steam, thereby cooling the combustion gases. The resulting steam-gas mixture is then routed through particle separator 32 before being delivered to the hot side of the boiler 122. The secondary mixing chamber 150 is preferably contained within the gas generator 14 as detailed above with respect to the second mixing chamber 28 of FIG. 3.

A performance analysis was conducted for a 12.75 inch diameter underwater vehicle with a length-to-diameter ratio of 14.1. Specific design goals included a vehicle speed in excess of 120 knots, a minimum run time of 120 seconds and a minimum range of 4.0 nautical miles.

A turbo-hydroduct propulsion system 10, as depicted in FIGS. 1 and 3, was configured for the above requirements. The system 10 included turbopump 16 having a two stage turbine 22 having diameters of about 6.5 inches and 7.2 inches respectively, driving a single stage pump 24 having a diameter of 3.2 inches. The combined efficiency of the turbopump 16 running at a depth of 500 feet and a static pressure of 240 psia was 0.52. The turbopump 16 operated at a rotational speed of about 25,000 rpm and a water flow rate of about 175 pounds per second. The system mixes the multiphase flow within the primary mixing chambers to a pressure of 2475 psia, approximately 2235 pounds per square inch greater than the ambient pressure at the 500 foot depth. The multiphase flow is accelerated through the nozzle assembly 20 to a speed of about 1000 feet per second. The system 10 had a specific impulse in excess of 600 pound force second per pound mass, or approximately three times greater than a solid propellant rocket using the same fuel. Thus, the turbo-hydroduct exceeds the design goal when the efficiency of the turbopump 16 is greater than 50 percent.

A similarly configured and constrained Rankinepowered turbo-hydroduct propulsion system 120 as shown in FIG. 6 yielded a specific impulse in excess of 1200 lbf-sec/lbm at a fuel-to-water ratio of 0.01. This is approximately twice the specific impulse of the gas powered turbo-hydroduct propulsion system 10 and six times the specific impulse of a rocket. Such a high specific impulse is achieved by a unique feature in the Rankine powered turbo-hydroduct concept which effectively utilizes both the heat content and the pressure of the gas for propulsion purposes. The high temperature, high pressure gas transfers heat to the Rankine-cycle boiler 122 to generate steam and to power the turbopump 16. This allows an efficient conversion of thermal energy to mechanical power. The spent gas from the boiler 122 is low in temperature but retains a high pressure. The spent gas mixed with water and expanded through the nozzle assembly 20 allows an effective utilization of gas pressure for thrust production.

The range predicted is 4.1 nm at 120 knots and 5.3 nm at 100 knots. The range is comparable to that of the gas-powered turbo-hydroduct because of the size of the Rankine cycle boiler 122 and condensor 124, which reduce the space available for a propellant. The Rankine-powered turbo-hydroduct propulsion system 120 has low sensitivity to depth. The low depth sensitivity is achieved by utilizing a relatively small amount of gas to power the hydroduct. In effect, the turbo-hydroduct acts like a waterjet in deep water and a turbopump augmented underwater ramjet in shallow water.

It should be evident from the foregoing description that the present invention provides many advantages within the field of underwater vehicle propulsion.

Although preferred embodiments are specifically illustrated and described herein, it will be appreciated that many modifications and variations of the present invention are possible in light of the above teaching to those skilled in the art. It is preferred, therefore, that the present invention be limited not by the specific disclosure herein, but only by the appended claims.

I claim:

1. A method of producing propulsive thrust for an underwater vehicle comprising the steps of:

providing a propellant storage tank contained within the underwater vehicle for storing a high energy propellant;

combusting said propellant within a gas generator mounted within the vehicle to produce a flow of high temperature pressurized combustion gases;

extracting energy from said flow of combustion gases to power a high pressure water pump;

pressurizing a flow of ingested ambient water within said high pressure water pump to a pressure at least 200 psi greater than ambient water pressure;

diverting a portion of said pressurized water to a second mixing chamber, said second mixing chamber receiving all of said combustion gases directly from said gas generator;

spraying said diverted water into said combustion gases to cause evaporation of all of said diverted portion of water, thereby increasing the extractable energy available from a resulting mixed combustion gas-steam flow;

mixing at least a portion of said flow of combustion gases with said flow of pressurized water within a primary mixing chamber; and ejecting said mixed flow of gases and pressurized water to ambient through a nozzle assembly associated with said primary mixing chamber to generate thrust.

2. The method of claim 1, further comprising the step of:

separating salt particles from said combustion gas-steam flow within a particle separator prior to extracting energy therefrom.

3. The method of claim 1, wherein said extracting step comprises:

conducting at least a portion of said mixed combustion gas-steam flow from said second mixing chamber to a turbine; and expanding said combustion gas-steam flow within said turbine to extract useful work therefrom, said turbine being mechanically attached to and driving said pump.

4. The method of claim 1, further comprising the steps of:

diverting a second portion of said pressurized water to a third mixing chamber;

diverting a portion of said combustion gases from said second mixing chamber to said third mixing chamber;

mixing said diverted water into said combustion gases in said third mixing chamber to cause evaporation of said water thereby producing a mixed combustion gas-steam flow; and conducting said gas-steam flow from said third mixing chamber to said primary mixing chamber.

5. The method of claim 2, wherein said extracting step comprises:

conducting said mixed combustion gas-steam flow from said second mixing chamber to a turbine; and expanding said combustion gas-steam flow within said turbine to extract useful work therefrom, said turbine being mechanically attached to and driving said pump.

6. The method of claim 3, further comprising the steps of:

cooling said expanded combustion gases from said turbine within a condenser to condense vapors carried therein in heat exchange relationship with said ingested water;

separating said condensate from the remainder of said gases;

pressurizing said condensate within a second pump;

discharging said pressurized condensate overboard of said underwater vehicle;

pressurizing said remaining gases within a compressor; and exhausting said pressurized gases from said underwater vehicle.

7. A method of producing propulsive thrust for an underwater vehicle comprising the steps of:

providing a propellant storage tank contained within the underwater vehicle for storing a high energy propellant;

combustion said propellant within a gas generator mounted within the vehicle to produce a flow of high temperature pressurized combustion gases;

extracting energy from said flow of combustion gases to power a high pressure water pump said extracting step includes conducting at least a portion of said flow of combustion gases to a turbine and expanding said combustion gases within said turbine to extract useful work therefrom, said turbine being mechanically attached to and driving said pump;

pressurizing a flow of ingested ambient water within said high pressure water pump to a pressure at least 200 psi greater than ambient water pressure;

mixing at least a portion of said flow of combustion gases with said flow of pressurized water within a primary mixing chamber; and ejecting said mixed flow of gases and pressurized water to ambient through a nozzle assembly associated with said primary mixing chamber to generate thrust.

8. The method of claim 7, further comprising the steps of:

cooling said expanded combustion gases from said turbine within a condenser to condense vapors carried therein to a condensate in heat exchange relationship with said ingested water;

separating said condensate from the remainder of said cooled and expanded combustion gases;

pressurizing said condensate within a second pump;

discharging said pressurized condensate overboard of said underwater vehicle;

pressurizing said remaining gases within a compressor; and exhausting said pressurized gases from said underwater vehicle.

9. A method of producing propulsive thrust for an underwater vehicle comprising the steps of:

providing a propellant storage tank contained within the underwater vehicle for storing a high energy propellant;

combusting said propellant within a gas generator mounted within the vehicle to produce a flow of high temperature pressurized combustion gases;

extracting energy from said flow of combustion gases to power a high pressure water pump said extracting step includes conducting at least a portion of said combustion gases from said gas generator through a hot side of a boiler wherein said combustion gases are cooled, heating a liquid in heat exchange relationship with said combustion gases within said boiler to a temperature in excess of the boiling temperature of said liquid to produce steam, expanding said steam from said boiler within a turbine to extract useful work therefrom and to cool said steam, said turbine drivingly connected to said water pump, condensing said cooled steam from said turbine to a liquid within a condenser in heat exchange relationship with said ingested water, pumping said liquid from said condenser to said boiler;

pressurizing a fluid of ingested ambient water within said high pressure water pump to a pressure at least 200 psi greater than ambient water pressure;

mixing at least a portion of said flow of combustion gases with said flow of pressurized water within a primary mixing chamber; and ejecting said mixed flow of gases and pressurized water to ambient through a nozzle assembly associated with said primary mixing chamber to generate thrust.

10. The method of claim 9, further comprising the steps of:

diverting a portion of said pressurized water from said water pump to a pre-mixing chamber;

diverting another portion of said combustion gases from said gas generator to said pre-mixing chamber;

mixing said diverted water into said combustion gases within said pre-mixing chamber to cause evaporation of said water thereby producing a mixed combustion gas-steam flow; and conducting said gas-steam flow from said pre-mixing chamber to said primary mixing chamber.

11. The method of claim 9, further comprising the step of:

conducting said cooled combustion gases from said hot side of said boiler to said primary mixing chamber.

12. The method of claim 9, further comprising the steps of:

further cooling said cooled combustion gases from said boiler within a condenser to condense vapors carried therein to a condensate in heat exchange relationship with said ingested water;

separating said condensate from the remainder of said gases;

pressurizing said condensate within a second pump;

discharging said pressurized condensate overboard of said underwater vehicle;

pressurizing said remaining gases within a compressor; and exhausting said pressurized gases from said underwater vehicle.

13. A method of producing propulsive thrust for an underwater vehicle comprising the steps of:

providing a propellant storage tank contained within the underwater vehicle for storing a high energy propellant;

combusting said propellant within a gas generator mounted within the vehicle to produce a flow of high temperature pressurized combustion gases;

extracting energy from said flow of combustion gases to power a high pressure water pump said extracting step including the steps of diverting a portion of said pressurized water to a second mixing chamber, said second mixing chamber receiving all of said combustion gases directly from said gas generator, spraying said diverted water into said combustion gases to cause evaporation of said water forming a mixed combustion gas-steam flow, thereby increasing the extractable energy available from the mixed combustion gas-steam flow, conducting said combustion gas-steam flow through a hot side of a boiler wherein said combustion gas-steam flow is cooled, heating a liquid in heat exchange relationship with said combustion gas-steam flow within said boiler to a temperature in excess of the boiling temperature of said liquid to produce steam, expanding said steam from said boiler within a turbine to extract useful work therefrom and to cool said steam, said turbine being drivingly connected to said water pump, condensing said cooled steam from said turbine to a liquid within a condenser in heat exchange relationship with said ingested water, and pumping said liquid from said condenser to said boiler;

pressurizing a flow of ingested ambient water within said high pressure water pump to a pressure at least 200 psi greater than ambient water pressure;

mixing at least a portion of said flow of combustion gases with said flow of pressurized water within a primary mixing chamber; and ejecting said mixed flow of gases and pressurized water to ambient through a nozzle assembly associated with said primary mixing chamber to generate thrust.

14. The method of claim 13, further comprising the step of:

conducting said cooled combustion gas-steam flow from said boiler to said primary mixing chamber.

15. The method of claim 13, further comprising the steps of:

further cooling said cooled combustion gas-steam flow from said boiler within a condenser to condense vapors carried therein to a condensate in heat exchange relationship with said ingested water;

separating said condensate from the remainder of said combustion gases;

pressurizing said condensate within a second pump;

discharging said pressurized condensate overboard of said underwater vehicle;

pressurizing said remaining combustion gases within a compressor; and exhausting said pressurized combustion gases from said underwater vehicle.

16. A method of producing propulsive thrust for an underwater vehicle comprising the steps of:

combusting a propellant within a gas generator mounted within the vehicle to produce a flow of high temperature pressurized combustion gases;

directing a flow of pressurized water to a secondary mixing chamber, said secondary mixing chamber receiving at least a portion of said combustion gases from said gas generator;

spraying said pressurized water into said portion of said combustion gases in said secondary mixing chamber to cause evaporation of said water, thereby increasing the extractable energy available from a resulting mixed combustion gas-stream flow;

separating solid particles out of said combustion gas-steam flow within a particle separator;

extracting energy from said mixed flow of combustion gas and steam to power a high pressure water pump;

pressurizing a flow of ingested ambient water within said high pressure water pump to a pressure at least 500 psi greater than ambient water pressure;

mixing at least a portion of said flow of combustion gases with at least a portion of said flow of pressurized water within a primary mixing chamber; and ejecting said mixed flow of gases and pressurized water to ambient through a nozzle assembly associated with said primary mixing chamber to generate thrust.

17. The method of claim 16, wherein said extracting step comprises:

conducting said mixed combustion gas-steam flow from said secondary mixing chamber to a turbine; and expanding said combustion gas-steam flow within said turbine to extract useful work therefrom, said turbine being mechanically attached to and driving said high pressure water pump.

18. The method of claim 16, wherein said extracting step comprises:

conducting said combustion gas-steam flow from said secondary mixing chamber through the hot side of a boiler wherein said combustion gas-steam is cooled;

heating a liquid in heat exchange relationship with said combustion gas-steam flow within said boiler to a temperature in excess of the boiling temperature of said liquid to produce steam;

expanding said steam within a turbine to extract useful work therefrom and to cool said steam, said turbine being drivingly connected to said high pressure water pump;

condensing said cooled steam from said turbine to a liquid within a condensed in heat exchange relationship with said ingested water; and pumping said liquid from said condenser to said boiler.

19. A propulsion system for an underwater vehicle comprising:

a propellant storage tank;

gas generator means, mounted within said vehicle, for receiving and combustion propellant from said propellant storage tank producing a flow of high temperature pressurized combustion gases;

means for extracting energy from said flow of combustion gases;

high pressure water pump for pressurizing a flow of ingested ambient water to a pressure at least 200 psi greater than ambient water pressure, said pump means powered by said means for extracting energy;

primary mixing chamber means for receiving at least a portion of said flow of combustion gases and at least a portion of said flow of pressurized water and for mixing said gases and said pressurized water forming a mixed flow;

second mixing chamber means for receiving a diverted portion of said pressurized water and at least a portion of said combustion gases from said gas generator means, and for spraying said diverted water into said combustion gases to cause evaporation of said water thereby producing a mixed gas-steam flow;

conduit means for conducting said mixed gas-steam flow from said second mixing chamber means to said means for extracting energy; and nozzle means for receiving said mixed flow from said primary mixing chamber means and for ejecting said mixed flow to ambient to generate thrust.

20. A propulsion system for an underwater vehicle comprising:

a propellant storage tank;

gas generator means, mounted within said vehicle, for receiving and combusting propellant from said propellant storage tank producing a flow of high temperature pressurized combustion gases;

means for extracting energy from said flow of combustion gases said means for extracting energy including turbine means for expanding said combustion gases to extract useful work therefrom high pressure water pump means for pressurizing a flow of ingested ambient water to a pressure at least 200 psi greater than ambient water pressure, said pump means mechanically attached to and powered by said turbine means of said means for extracting energy;

primary mixing chamber means for receiving at least a portion of said flow of combustion gases and at least a portion of said flow of pressurized water and for mixing said gases and said pressurized water forming a mixed flow; and nozzle means for receiving said mixed flow from said primary mixing chamber means and for ejecting said mixed flow to ambient to generate thrust.

21. The apparatus of claim 19, further comprising:

particle separator means for separating solid particles out of said mixed gas-steam flow, said particle separator mounted between said second mixing chamber means and said means for extracting energy.

22. The apparatus of claim 20, further comprising:

condenser means for cooling said expanded combustion gases to condense vapors carried therein to a condensate in heat exchange relationship with said ingested water;

condensate separator means for separating said condensate from the remainder of said gases;

second pump means for pressurizing said condensate;

duct means for discharging said pressurized condensate to ambient;

compressor means for pressurizing said remaining gases; and exhaust conduit means for exhausting said pressurized gases to ambient.

23. A propulsion system for an underwater vehicle comprising:

a propellant storage tank;

gas generator means, mounted within each vehicle, for receiving and combusting propellant from said propellant storage tank producing a flow of high temperature pressurized combustion gases;

means for extracting energy from said flow of combustion gases said means for extracting energy including boiler means for heating a liquid in heat exchange relationship with said combustion gases from said gas generator means to a temperature in excess of the boiling temperature of said liquid to produce steam, conduit means for conducting said combustion gases from said gas generator means to said boiler means, turbine means for receiving said steam from said boiler means and for expanding said steam to extract useful work therefrom while cooling said steam, condenser means for condensing said cooled steam to a liquid in heat exchange relationship with said ingested water, duct means for transporting said condensed liquid from said condenser means to said boiler means, and a second pump within said duct means for pumping said liquid from said condenser to said boiler;

high pressure water pump means for pressurizing a flow of ingested ambient water to a pressure at least 200 psi greater than ambient water pressure, said water pump means mechanically attached to and driven by said turbine means of said means for extracting energy;

primary mixing chamber means for receiving at least a portion of said flow of combustion gases and at least a portion of said flow of pressurized water and for mixing said gases and said pressurized water forming a mixed flow; and nozzle means for receiving said mixed flow from said primary mixing chamber means and for ejecting said mixed flow to ambient to generate thrust.

24. The apparatus of claim 23, further comprising:

premixing chamber means for mixing pressurized water and combustion gases and for producing a mixed gas-steam flow;

duct means for diverting a portion of said pressurized water from said pump means to said premixing chamber means;

conduit means for diverting a portion of said combustion gases from said gas generation means to said premixing chamber means; and conduit means for conducting said mixed gas-steam flow from said premixing chamber means to said primary mixing chamber means.

25. The apparatus of claim 23, further comprising:

second condenser means for cooling said cooled and expanded combustion gases to condense vapors carried therein to a condensate in heat exchange relationship with said ingested water;

water separator means for separating said condensate from the remainder of said gases;

pump means for pressurizing said condensate;

duct means for discharging said pressurized condensate to ambient;

compressor means for pressurizing said remaining gases; and exhaust conduit means for exhausting said pressurized gases to ambient.

26. A propulsion system for an underwater vehicle comprising:

a propellant storage tank;

gas generator means, mounted within said vehicle, for receiving and combusting propellant from said propellant storage tank producing a flow of high temperature pressurized combustion gases;

means for extracting energy from said flow of combustion gases, said means for extracting energy including second mixing chamber means for mixing pressurized water into said combustion gases received from said gas generator means to form a mixed gas-steam flow, duct means for diverting a portion of said pressurized water to said second mixing chamber, boiler means for heating a liquid in heat exchange relationship with at least a portion of said mixed gas-steam flow from said second mixing chamber means said liquid heated within said boiler to a temperature in excess of the boiling temperature of said liquid to produce steam, conduit means for conducting said mixed gas-steam flow from said second mixing chamber means to said boiler means, turbine means for expanding said steam to extract useful work therefrom and to cool said steam, condenser means for condensing said cooled steam to a liquid in heat exchange relationship with said ingested water, duct means for conducting said liquid from said condenser means to said boiler means, and a second pump within said duct means to pump said liquid from said condenser to said boiler;

high pressure water pump means for pressurizing a flow of ingested ambient water to a pressure at least 200 psi greater than ambient water pressure, said water pump means mechanically attached to and driven by said turbine means of said means for extracting energy;

primary mixing chamber means for receiving at least a portion of said flow of combustion gases and at least a portion of said flow of pressurized water and for mixing said gases and said pressurized water forming a mixed flow; and nozzle means for receiving said mixed flow from said primary mixing chamber means and for ejecting said mixed flow to ambient to generate thrust.

27. The apparatus of claim 26, further comprising:

second condenser means for cooling said cooled mixed gas-steam flow from said boiler means to condense vapors carried therein in heat exchange relationship with said ingested condensate separator means for separating said condensate from the remainder of said mixed gases;

second pump means for pressurizing said condensate;

duct means for discharging said pressurized condensate from said second pump means to ambient;

compressor means for pressurizing said remaining gases; and exhaust conduit means for exhausting said pressurized gases to ambient.

* * * * *